United States Patent [19]

Fisher et al.

[11] Patent Number: 4,684,810

[45] Date of Patent: Aug. 4, 1987

[54] X-RAY SHIELD FOR FLUORESCENT LIGHT TUBE

[76] Inventors: Ina E. Fisher, 411 NW. 4th St., Andrews, Tex. 79714; Richard C. Raney, 2600 Culver, Midland, Tex. 79701

[21] Appl. No.: 436,483

[22] Filed: Apr. 4, 1983

Related U.S. Application Data

[63] Continuation of Ser. No. 963,331, Nov. 24, 1978, abandoned.

[51] Int. Cl.[4] ..... G21C 11/00; G21F 1/00

[52] U.S. Cl. ..... 250/515.1; 313/492

[58] Field of Search ..... 250/503.1, 504 R, 515.1, 250/520; 313/485, 489, 206, 207, 492

[56] References Cited

U.S. PATENT DOCUMENTS

| | | | |
|---|---|---|---|
| 2,528,235 | 10/1950 | Loritsch | 250/515 |
| 3,725,718 | 4/1973 | Quirk et al. | 250/520 |
| 3,767,957 | 10/1973 | Ott | 313/220 |

FOREIGN PATENT DOCUMENTS

| | | | |
|---|---|---|---|
| 840717 | 7/1960 | United Kingdom | 250/520 |

*Primary Examiner*—Bruce C. Anderson
*Attorney, Agent, or Firm*—Marcus L. Bates

[57] ABSTRACT

A cylindrical shield is affixed to the opposed marginal terminal end portions of a fluorescent light tube. The shields each include a layer of metallic substance which intersects X-rays emitted by the cathode of the tube to avoid the harmful effects that are brought about by the X-rays impinging upon people located nearby.

1 Claim, 7 Drawing Figures

X-RAY SHIELD FOR FLUORESCENT LIGHT TUBE

This is a abandoned continuation of application Ser. No. 963,331 filed Nov. 24, 1978 abandoned.

BACKGROUND OF THE INVENTION

Fluorescent lights have a cathode mounted near each terminal end thereof. The cathodes emit soft X-rays therefrom which propagate through the intervening space and impinge on anyone located in close proximity thereto. Tests and experiments show that absorption of these soft X-rays cause hyperactivity and learning disabilities in children. These emotional effects are sometime very pronounced, and as more advance studies are conducted, there is an indication that this radiation affects both children and adults. It is also known that plant life and animals are adversely effected by the soft X-rays.

The term "X-rays" or "soft X-rays", as used in this disclosure, is intended to denote the particles or matter or energy which is radiated from the cathode ends of a fluorescent light tube.

The widespread use of fluorescent lighting in schools, hospitals, offices, and public buildings indicates a need to protect animal and plant life from the soft X-rays emitted by the cathode end of the fluorescent lights. Such a desirable expedient is the subject of this invention.

SUMMARY OF THE INVENTION

A shield supported by the marginal opposed ends of a fluorescent light tube which intercepts soft X-rays and prevents propagation of the X-rays away from the light fixture thereof, thereby preventing the X-rays from adversely affecting animal and plant life which may be located in close proximity thereto.

In one embodiment of the invention, a shield is provided for each marginal end of a fluorescent light tube of a light fixture. The shield comprises a circumferentially extending layer of metal through which soft X-rays cannot pass. The shield surrounds the cathode located in each marginal end of the fluorescent tube.

One specific embodiment of the invention comprises a layer of metallic material applied as a coating to the interior surface of the marginal ends of the fluorescent tube. Another embodiment of the invention comprehends a layer of metallic material applied to the exterior surface of the marginal ends of the fluorescent tube. In each instance, the metallic material is finely divided and admixed with a suitable vehicle which enables it to be applied by painting the glass surface.

Another embodiment of the invention comprehends a tubular support structure having a length greater than the diameter of the tube, with there being a sheet of metal applied to the support structure so that the cylindrical shield can be telescoped about the marginal ends of a fluorescent tube, thereby supporting the metal sheet radially spaced about the cathode in a removable manner.

Another embodiment of the invention comprehends the before mentioned cylindrical, removable shield, which is provided with a longitudinally extending slot thereby providing spaced adjacent edge portions so that the cylindrical shield can be deformed and placed about the marginal ends of the fluorescent tube in intimate contact with the glass surface thereof. This embodiment of the invention enables the shield to be installed on a tube without removing the tube from the fixture.

Accordingly, a primary object of the present invention is the provision of apparatus in combination with a fluorescent tube which shields animal and plant life from the harmful effects of X-rays emitted from the cathode of the fluorescent tube.

Another object of the invention is the provision of a shield assembly in combination with the fluorescent light tube which forms a barrier for intercepting X-rays emitted by the cathode.

A further object of this invention is the provision of a shield device which is removably received about the opposed marginal terminal ends of a fluorescent tube to prevent X-rays from being propagated from a fluorescent light fixture.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
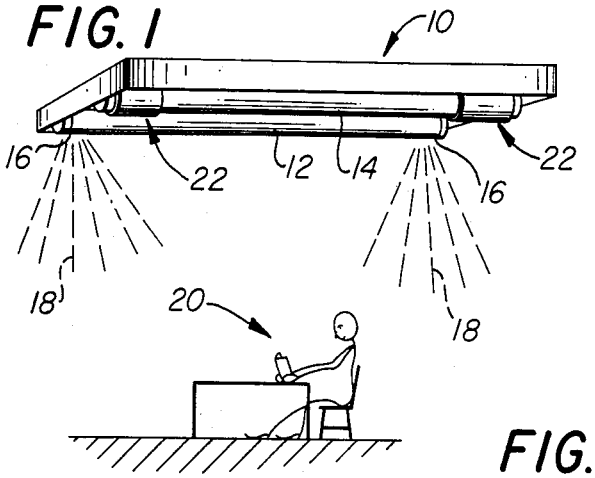
FIG. 1 is a perspective view of a fluorescent light fixture in combination with the shield of the present invention.

In FIG. 1, there is disclosed a fluorescent light fixture 10 having fluorescent tubes 12 and 14 mounted therein in the usual manner. The marginal ends 16 of tube 12 contain a cathode each of which emits soft X-rays as generally illustrated at numeral 18. A person seated at 20 is injured when the soft X-rays 18 impinge upon his person.

The tube 14 is provided with a shield assembly 22, made in accordance with the present invention. The shield assembly is supported by the marginal terminal ends of tube 14

Figure 2:
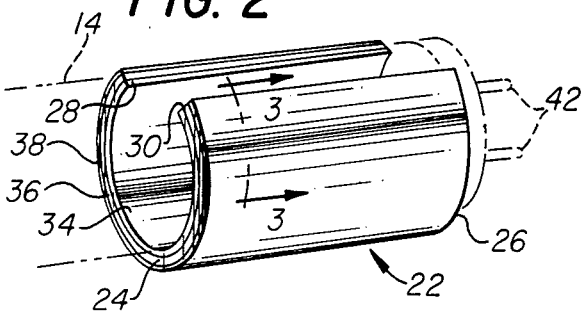
FIG. 2 is an enlarged, perspective view of one of the light shields disclosed in FIG. 1.

As seen in the embodiment disclosed in FIG. 2, the shield assembly 22 has an adjacent end 24 and an opposed end 26. The shield is generally cylindrical in form and is discontinuous because a longitudinally extending slot has been formed in a side wall thereof, thereby providing longitudinal spaced parallel edges 28 and 30.

Figure 3:
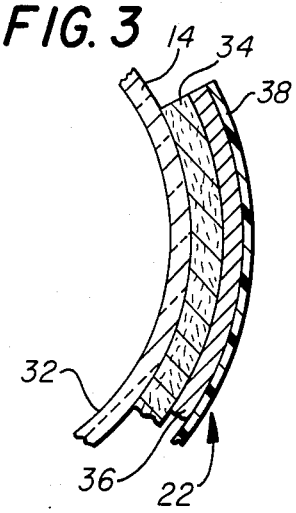
FIG. 3 is a fragmented, cross-sectional view taken along line 3—3 of FIG. 2.

In FIG. 3, the tube interior is indicated by numeral 32. A fiberous material 34, such as cardboard or heavy self-supporting paper, is covered by a sheet of lead 36. The lead sheet can be attached to the cardboard by any convenient method, as for example gluing the marginal edge portions thereof in proximity of the longitudinal extending edge portions 28 and 30. The exterior of the lead preferably is painted at 38 to provide an attractive finish, and to protect the lead from atmospheric oxidation, or other undesirable chemical reactions.

The shield assembly of FIGS. 2 and 3 is affixed to an existing tube 12 by outwardly deforming edges 28 and 30 so that the slot receives the marginal end of the tube therethrough, thereby enabling the shield to be installed in the manner of FIG. 1 without removing the tube from the fixture. The slot upwardly opens towards the light fixtures so that any radiation 18 in an upward direction through the slot is intercepted by the metal light fixture. In any event, the area of the slot can be made insignificant.

Figure 4:
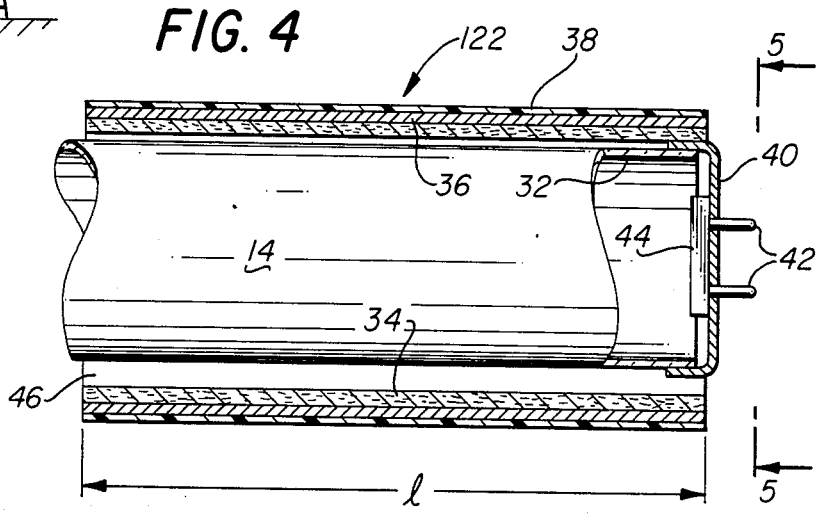
FIG. 4 is a fragmented, longitudinal, cross-sectional view of another form of the present invention.

In FIG. 4, the shield 122 is generally cylindrical in form and has a continuous outer peripheral surface area. The support member 34 and sheet of lead 36 extend 360° about the outer circumferentially extending surface of the cylinder. Numeral 38 indicates the attractive coating of paint or the like.

In the embodiment of FIGS. 2 and 4, the thickness of the lead sheet can vary from a thin foil of about 0.004 inches up to a thickness of 0.035 inches.

The end of the tube is provided with a conventional cap 40, electrical contacts 42, and a cathode 44 in the usual manner.

As seen illustrated by numeral 46, the shield assembly is loosely received in supported relationship about the exterior surface of the marginal ends of the tube. Therefore, the tube must be removed from the fixture in order to slide the cylinder over the marginal ends thereof. The length of the cylinder preferably is twice the diameter of the tube, and in any instance should be at least equal to the diameter of the tube in order to adequately shield radiation emitted from the cathode 44. A length in excess of three times the diameter is considered too long for such a length because it blocks out excess light from the tube.

Figure 6:
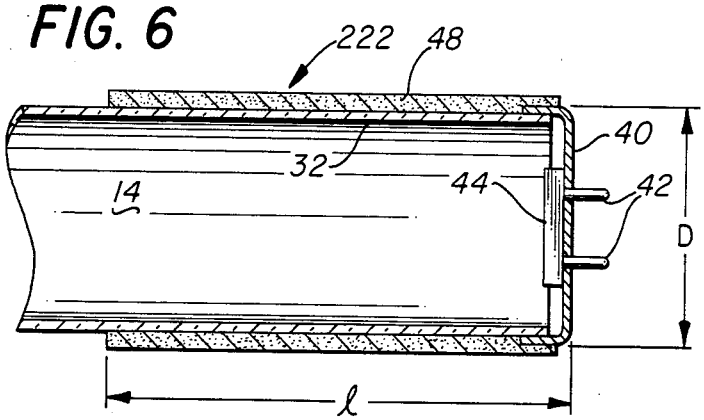
FIG. 6 is a fragmented, longitudinal, cross-sectional view of another form of the present invention; and, FIG. 7 is a fragmented, longitudinal, cross-sectional view of still another form of the present invention.

In FIG. 6, the shield 222 is seen to be comprised of a layer 48 of material having particles of metallic lead dispersed in sufficient concentration therewithin to intercept X-rays radiating from the cathode 44. The layer is formed by painting the outer surface. The metal is finely ground and admixed with the paint in sufficient quantity to shield the X-rays emitted by the cathode.

Figure 7:
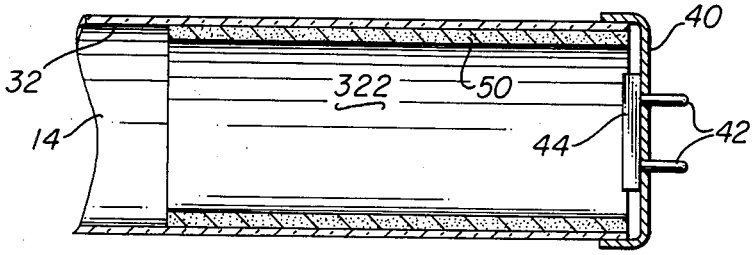

In FIG. 7, the shield 322 is comprised of a layer or coating of material 50 applied to the inside peripheral wall surface 32 of the marginal ends of the tube. The shield must be applied during manufacture of the tube.

The shield 50 is a layer of lead particles which is applied as in the previous example of FIG. 6, or alternatively, can be deposited by vapor condensation or by ordinary painting.

In practicing the present invention, the embodiment of FIG. 2 is affixed in supported relationship respective to the tubes 12 and 14 by springing the edge portions 28 and 30 apart from one another an amount sufficient to enable the marginal terminal end of the tube to be received therewithin, so that the resultant combination eliminates the X-rays 18 from impinging on a person 20 within the illustrated enclosure. The material from which the shield is made preferably is sufficiently resilient to be biased towards its original configuration of FIG. 2 after it has been sprung apart sufficiently to capture the marginal end of the tube therewithin. The shield is therefore supported by the tube, and when the tubes 12 and 14 are changed, the shield can be removed and placed about the new tube. Hence, the material from which the supporting member 34 is fabricated has sufficient memory so that when it is deformed and then released, the member is biased back towards its original configuration. The inside diameter of the shield 22 should therefore be slightly less than the outside diameter of the tube so that when the shield is installed on the tube, the memory of the material 34 causes the shield to slidably capture the tube therewithin.

The slot is oriented vertically upward so that any X-rays traveling therethrough are intercepted by the light fixture.

Figure 5:
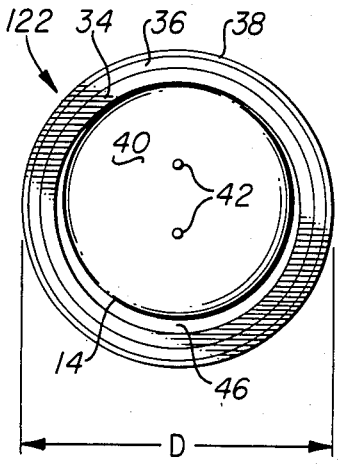
FIG. 5 is an end view looking in the direction indicated by the line 5—5 of FIG. 4.

In the embodiment of FIG. 4, the cylindrical continuous surface circumferentially surrounds the tube and therefore, the tube must be removed from the fixture in order to install the embodiment 122 thereon. The inside diameter of the shield 122 preferably is one thirty second to one eigth inch greater than the outside diameter of the tube. Therefore, the shield loosely captures the tube therewithin, with the marginal end of the tube supporting the shield in the illustrated manners of FIGS. 4 and 5. The shield gravitates into the illustrated position set forth in FIGS. 4 and 5.

In the illustrated embodiment of FIGS. 2–5, the supporting member 34 is made of self supporting cardboard, a rolled sheet of asbestos, heat resistent plastic material such a polypropylene, or a thin sheet of metal such as steel.

In the embodiment of FIG. 6, the shield 22 is comprised of a coating of material which has been applied by painting the external surface of the glass tube. The coating of material contains ground up metal particles of lead and is of a sufficient density to form an effective barrier through which the X-rays radiating from the cathode 44 cannot pass. One example of paint suitable for this embodiment is a mixture of 75% lead powder and 0.25% expoxy resin by volume.

In the embodiment of FIG. 7, the shield 322 is comprised of a coating of metallic lead 50. The metal is deposited onto the glass interior surface by vaporizing the metal and permitting it to condense onto the interior surface. The metal can also be applied as an adhesive backed lead foil.

The embodiments of FIGS. 6 and 7 are shields for one time use whereas the embodiments of FIGS. 2 and 4 can be continually used over and over again, as well as retrofitting existing fluorescent tubes.

I claim:

1. In a fluorescent light tube having opposed ends, electrical contact means at each of said opposed ends by which the tube can be supportedly mounted in a light fixture, a cathode located within each marginal end of the tube in electrical contact with said contact means; the combination with said fluorescent tube of an external and removable X-ray shield;

said shield being generally cylindrical in geometrical configuration; said shield includes a layer of metal having a thickness which substantially prevents X-rays from passing therethrough; said shield being of a size to be telescopingly received in a removable manner about the exterior of the tube so that said shield is supported on the exterior wall surface of the tube and at the marginal end portions of the tube in radially spaced relationship respective to the cathode thereof;

said shield has an inside diameter which is substantially greater than the outside diameter of said tube so that the shield is loosely and slidably received by the marginal end portions of the tube;

said shield is of sandwiched construction and includes a generally cylindrical support means which supports said layer of metal thereon; said layer of metal is a sheet of lead which is coextensive with and bonded to said cylindrical support means;

said cylindrical support means comprises a continuous piece of material, the circumference being made discontinuous by the provision of only one longitudinal slot which provides adjacent longitudinally extending edge portions; the slot being smaller than the diameter of the tube so that the edge portions can be sprung apart to enable the tube to be received through the slot so that the cylindrical support means can be placed about the tube while the tube is mounted in the fixture; and X-rays are therefore substantially intercepted by the shield and cannot be emitted from the fixture;

said cylindrical support means of said shield includes a cylindrical self-supporting cardboard support means which supports said layer of sheet lead thereon; the length of said cardboard support means is substantially twice the diameter of the tube;

said layer of sheet lead is bonded to the exterior of said cardboard support means.

* * * * *